US005528799A

United States Patent [19]

Bach et al.

[11] Patent Number: 5,528,799

[45] Date of Patent: Jun. 25, 1996

[54] THREAD-GUIDING COMPONENT WITH IMPROVED SURFACE

[75] Inventors: Josef Bach, Stadtbergen; Jürgen Lorenz, Berlin; Eugene Morach, Liederbach, all of Germany

[73] Assignee: Hoechst Aktiengesellschaft, Frankfurt am Main, Germany

[21] Appl. No.: 262,734

[22] Filed: Jun. 20, 1994

[30] Foreign Application Priority Data

Jun. 19, 1993 [DE] Germany ..... 9309155 U
Jul. 31, 1993 [DE] Germany ..... 9311461 U

[51] Int. Cl.[6] ..... D01H 5/74; B65H 27/00

[52] U.S. Cl. ..... 19/258; 492/28; 492/37

[58] Field of Search ..... 28/240, 245; 19/251, 19/258, 295; 492/28, 29, 30, 33, 34, 35, 36, 37, 53, 58

[56] References Cited

FOREIGN PATENT DOCUMENTS 0230633 8/1987 European Pat. Off. .
0287023 10/1988 European Pat. Off. .
0423063 4/1991 European Pat. Off. .
2643913 3/1990 France .
1270912 6/1968 Germany .
3218402 11/1983 Germany .
4101680 7/1992 Germany .
2215924 4/1993 Germany .
414414 12/1966 Netherlands .

*Primary Examiner*—John J. Calvert
*Assistant Examiner*—Larry D. Worrell, Jr.
*Attorney, Agent, or Firm*—Connolly and Hutz

[57] ABSTRACT

Described are thread-guiding components for apparatus for producing, treating and processing fiber materials, having a surface which comes into contact with the fiber materials defined by certain values of the maximum averaged roughness depth $R_z$ and the values of the load-bearing proportion calculated for certain depths of cut. The defined surface comprises a cermet material. Preferably there is additionally deposited on it an outer layer, from 0.1 to 10.0 μm in thickness of nitrides and/or carbides of titanium or chromium. The components are notable for significantly enhanced long-term stability of the surface properties. The components are preferably godets.

23 Claims, 4 Drawing Sheets

THREAD-GUIDING COMPONENT WITH IMPROVED SURFACE

BACKGROUND OF THE INVENTION

The present invention relates to thread-guiding components of a facility for the production, treatment and processing of fiber materials with a surface coming into contact with said fiber materials or their raw materials and whose properties change only little in continuous operation over a prolonged period of time and which therefore, in comparison with corresponding conventional components, have a considerably improved service life.

In the production of synthetic fibers numerous components are used which come into close contact with the spun, fast-moving threads while having to fulfill various functions. Examples of such components are bundling and deflecting devices, which are intended to combine the plurality of filaments or change the path direction of filament bundles, snubbing pins, which have to define the stretching point of filament paths, take-off godets, i.e. rolls which haul off the plurality of threads from the spinneret, drawing godets, between which the filament bundles are drawn and thereby oriented and consolidated, intermingling jets, in which the filament bundles passing through are intermingled by blown-in compressed air in order that the textile effect of the threads and the holding-together of the individual filaments of the threads (yarn adhesion) may be improved. Depending on the type of duty, the filaments come into contact with the components slidingly, as in the case of deflecting devices or intermingling Jets, or they are to come into contact with the components in more or less positive or at least frictional form, as in the case of take-off or drawing godets, or in sliding contact, in which case, however, defined forces are to be transmitted, as in the case for example of snubbing pins.

It has long been known that the quality of threads obtained is in large measure dependent on the flawless quality of the surfaces of these components and that changes in the surface in the course of continuous operation lead after a certain period of operation ("service life") to a considerable increase in the faults in the fiber material produced, making it necessary to replace the component. The replacement of the component is costly, since there is not only the expense of a new or reconditioned component but production has to be interrupted for a certain period of time, which incurs considerable additional costs.

It has therefore long been customary to manufacture such thread-guiding components from very wear-resistant materials which retain a defined surface over a long period of operation so as to ensure very long service lives. A source of particularly frequent problems are the godets, which serve to convey the fiber materials. They must on the one hand be able to apply to the fiber materials going around them a high tensile force, which requires a positive, or at least frictional, contact, but they must not tend to bind the individual filaments too strongly, since these are otherwise torn from the fiber bundle and form problem wraps on the godet. Such godets are therefore expected to have a very advantageous grip-release behavior. Filament breakages, however, impair not only the production process but also represent quality defects, which can lead to serious difficulties in the further processing of the threads.

Widely used are godets whose surface comprises a ceramic material, preferably a ceramic mixture of $Al_2O_3$ with from 3 to 20% by weight of $TiO_2$, in particular with about 13% by weight of $TiO_2$. These standard godets can be used in both feed and take-off systems and make it possible to obtain an at least practicable degree of sustained operation from a spinning machine. However, even with these godets the service life is not all that may be desired; especially the service lives vary randomly from godet to godet and, what is more, this variation is increased by different loadings on the godets, depending on their specific duty. Increasing godet wear will be recognized by one skilled in the art by the increase in faults (filament breakages) and there is then the additional problem of finding out which of the large number of godets in a spinning plant is causing these faults.

There has therefore been no shortage of attempts to improve the service life of thread-guiding components of spinning plants, in particular of godets. German Patent 3,218,402, for example, discloses providing thread-guiding components, such as godets or snubbing pins, with a coating of a cermet mixture containing 50–90% by weight of chromium carbide as the ceramic component and 50–10% by weight of a nickel-chromium alloy as the metal component. Compared with conventional surfaces of $Al_2O_3/TiO_2$, this surface proves to be distinctly superior. Nonetheless, there is still room for improvement; in particular, this surface too does not make it easy to discern the state of wear.

European Patent 0 230 633 discloses providing the surface of thread-guiding components with a ceramic or metal carbide coating and draws attention in particular to tungsten carbide, but also titanium carbide, tungsten/titanium carbide and chromium carbide, alone or combined with cobalt, nickel, chromium or iron, but also to pure ceramic compositions from oxides of aluminum, aluminum/titanium, chromium, chromium/aluminum or zirconium/magnesium. To produce a defined surface quality, these layers are initially treated with an epoxy resin which closes the pores of the layer, subsequently ground to a low roughness Ra=0.2 to 0.76 μm and finally provided by laser etching with a multiplicity, for example from 80 to 550, depressions per inch which have a depth from a few μm to over 140 μm.

It has also already been proposed to overcome the disadvantages of the state of the art by using in apparatus for producing, treating and processing fiber materials components which are characterized in that the component surface which comes into contact with the fiber material or the raw material consists of a first layer of nitrides and/or carbides of titanium or chromium deposited in a thickness from 0.1 to 10.0 μm, preferably from 1 to 5 μm, on a component or on a second layer of a material having a specific electric resistance of not more than 25, preferably from 20 to about 1.5 μΩ·cm.

It is true that this measure leads to a useful improvement in the application properties of the components, but the long-term constancy of the surface properties still leaves something to be desired.

SUMMARY OF THE INVENTION

It is an object of the present invention to construct the surface of godets in such a way that a surface structure having favorable grip-release characteristics may be preserved in operation for a very long time.

It has now been found that the long-term stability of godet surfaces can be decisively further improved by taking care from the start to produce a certain topography for the surface. The present invention thus provides thread-guiding components, in particular godets, having a defined surface topography.

The thread-guiding components of the invention have at least in the areas coming into contact with the fiber material a surface composed of a material having a specific electric resistance of not more than 25, preferably from 20 to about 1.5 μΩ·cm and characterized in that a) the 5 measurement average value $\overline{R_{max}}$ of its maximum roughness depth $R_{max}$ is between 20 and 30 μm, with a root mean square deviation from 3 to 8 μm, and b) the 5 measurement average value $\overline{R_z}$ of its averaged roughness depth $R_z$ is between 15 and 25 μm, with a root mean square deviation from 2 to 5 μm.

Preferably the surface which comes into contact with the fiber material is constructed so that c) the load-bearing proportion works out at 10% for a plane at a depth of cut from 6 to 12 μm and at 90% for a plane at a depth of cut from 18 to 25 μm, and d) the slope of the depth of cut/load-bearing proportion function is from 0.11 to 0.16 μm/% within the load-bearing proportion range from 30 to 70%.

The components of the invention, especially when they have relatively small dimensions, as is the case for example with intermingling jets, may consist in their entirety of the material having a specific electric resistance of not more than 25, preferably from 20 to about 1.5 μΩ·cm. Larger components, for example godets, in contrast, consist advantageously as usual of suitable steels and are provided at least in the areas of their surface which come into contact with the fiber materials with a "thick" layer of such a cermet material. Such a "thick" layer, applied as a coating, usually has a thickness from 100 to 400 μm, preferably from 150 to 300 μm.

The surface topography is measured using an instrument which senses the contour of the surface along a line, usually 5 mm in length, with a sensing needle whose tip advantageously has a curvature radius of about 5 μm. The reported topography values are based on such sensing. Suitable for determining the surface topography is for example a Perthometer M4P from Feinprüf-Perthen, equipped with a sensing needle of type TKX 300 with a curvature of 5 μm.

The deflections of the needle are stored digitally and the resulting course of the surface profile is evaluated arithmetically. At the same time the surface profile may be depicted graphically along the line of measurement.

DETAILED DESCRIPTION OF THE PREFERRED EMBODIMENT

Figure 1:
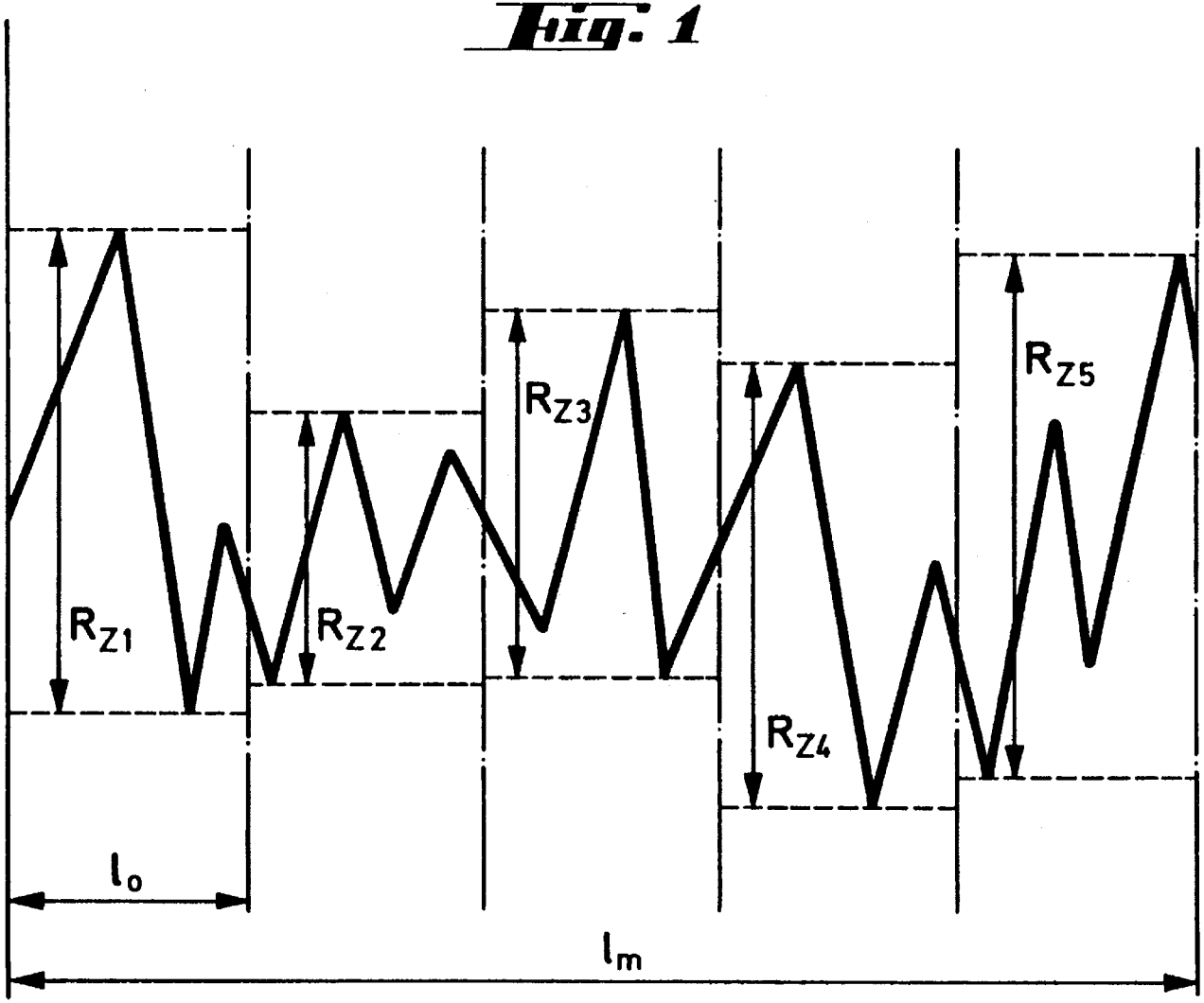
FIG. 1 shows a schematic representation of such a surface profile by way of explanation of the terms "maximum roughness depth" and "averaged roughness depth".

It can be seen from FIG. 1 that the roughness depth is the distance in μm between the lowest point and the highest point of a profile section. To determine the averaged roughness depth $R_z$, a measurement section $l_m$ is divided into 5 equal portions $l_0$ and each portion $l_0$ has its individual roughness depth $R_{xi}$ determined. The arithmetic average of the resulting 5 individual values $R_{z1}, R_{z2}, \ldots$ etc. is the value of the averaged roughness depth $R_z$.

$$R_z = 1/5 \cdot (R_{z1} + R_{z2} + R_{z3} + R_{z4} + R_{z5})$$

The maximum roughness depth $R_{max}$ is the largest of the five measured individual values of the roughness depth.

The averages $\overline{R_{max}}$ and $\overline{R_z}$ specified above under point a) are the result of arithmetically averaging 5 measurements of, respectively $R_{max}$ and $R_z$.

$$\overline{R_{max}} = 1/5 \cdot (R_{max1} + R_{max2} + R_{max3} + R_{max4} + R_{max5})$$

$$\overline{R_Z} = 1/25 \cdot \sum_{i=1}^{i=25} R_{Zi}$$

Each reported average $\overline{R_{max}}$ and $\overline{R_z}$ is thus based on the measured values from 25 individual portions $l_0$.

Figure 2:
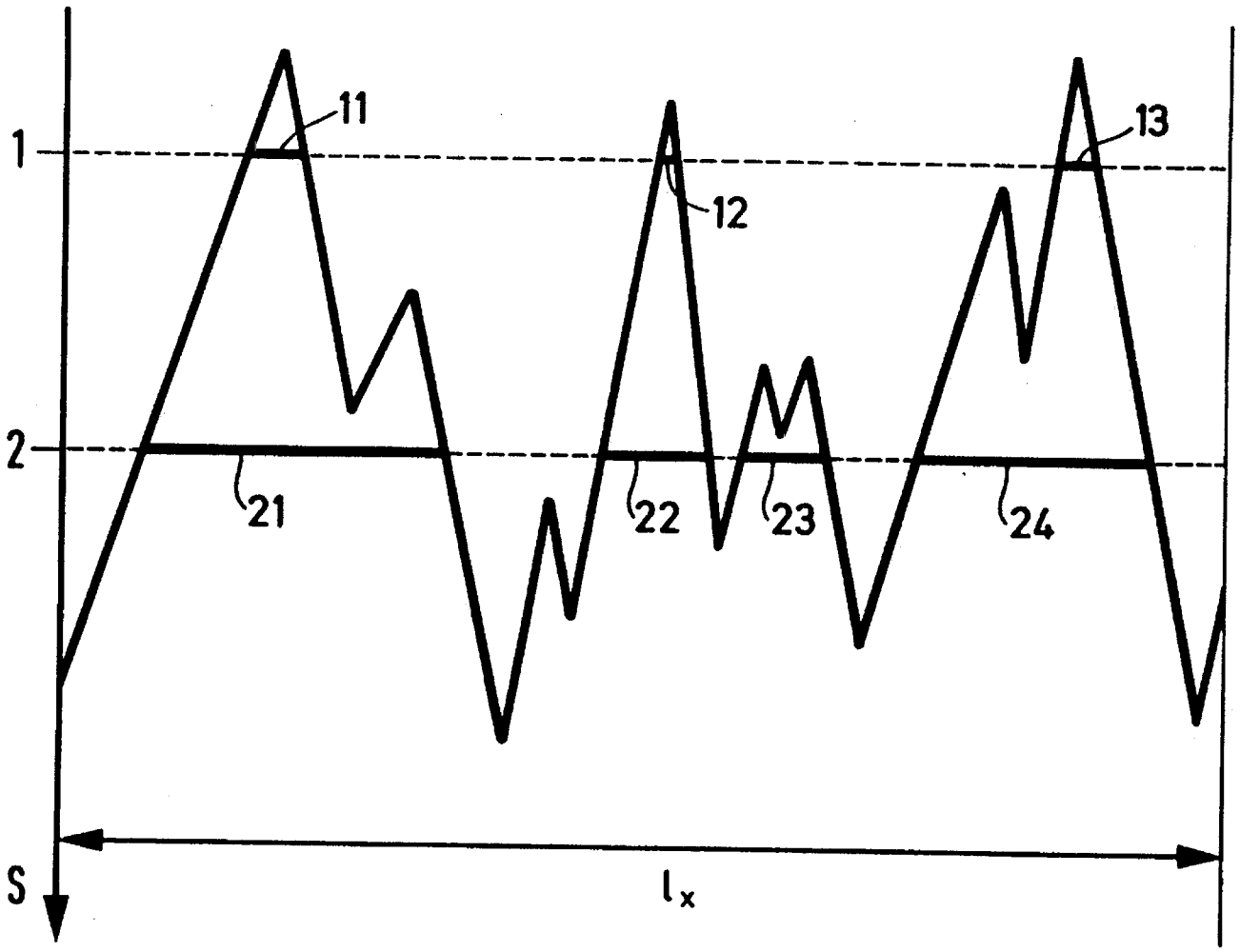
FIG. 2 serves to explain the term "load-bearing proportion".

FIG. 2 shows part of a section through a surface profile, showing the cutting planes (1) and (2) as broken lines. Plane (1) cuts the profile in the more boldly drawn regions (11), (12) and (13), while plane (2) cuts the profile in the regions (21), (22), (23) and (24).

The sum of the lengths $l_{is}$ of these regions in proportion to the total length of the measurement section $l_x$ is the load-bearing proportion $TA_s$ at the depth of cut S.

$$TA_S\,[\%] = \frac{100 \cdot \sum_{i=1}^{i=n} l_{is}}{l_x}$$

The load-bearing proportion $TA_s$ is accordingly a function of the depth of cut S.

$$TA_s = f(S)$$

Figure 3:
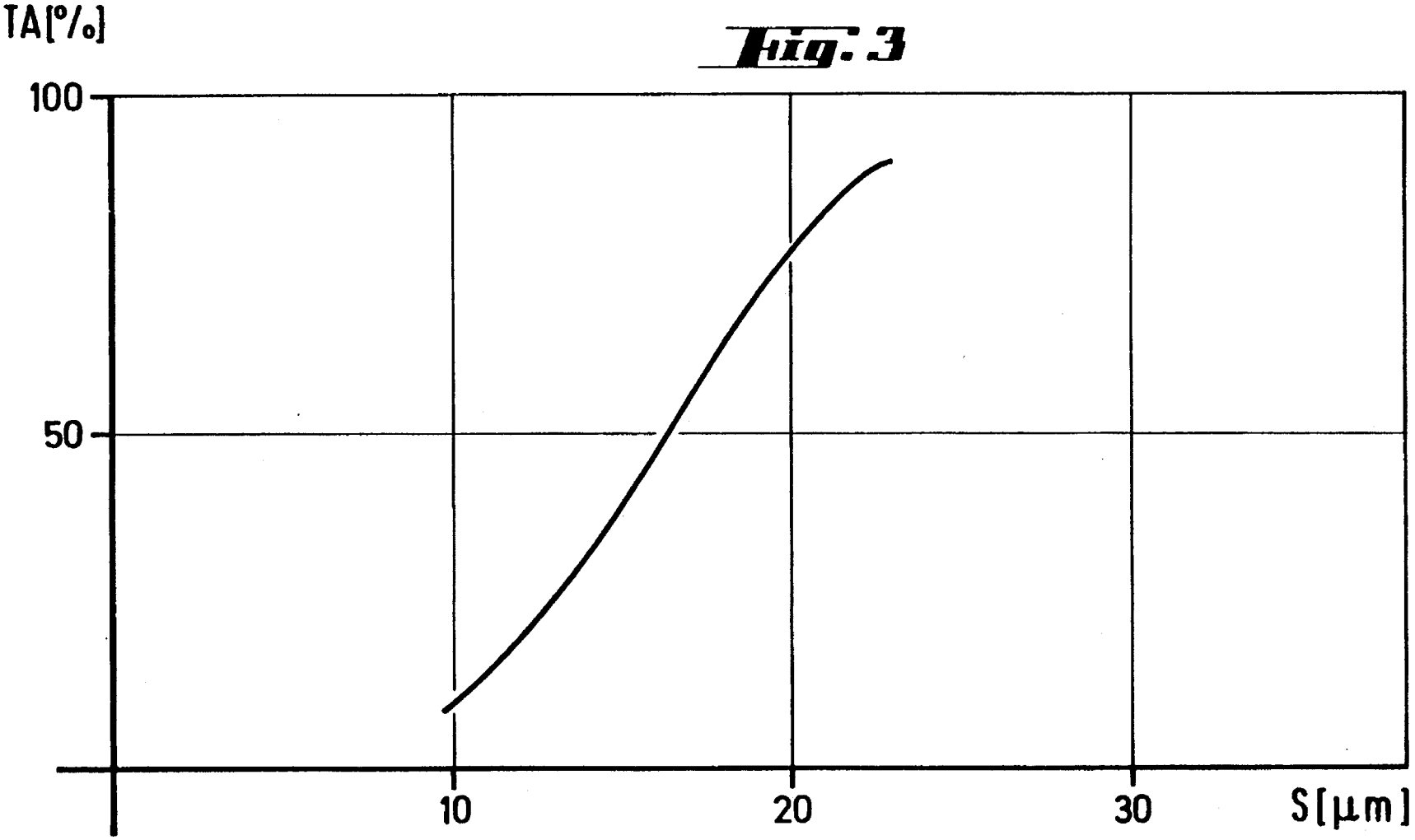
FIG. 3 is a graphical representation of a function over the load bearing proportion range from 10 to 90%.

FIG. 3 is a graphical representation of such a function over the load-bearing proportion range from 10 to 90%.

Particular preference is given to components according to the invention, in particular godets, which have atop the above-described surface of defined topography additionally a particularly hard outer layer.

The outer layer, which because of its low thickness should be viewed as a "thin" layer, consists preferably of titanium nitride (TIN), and/or titanium carbonitride (Ti(C,N)) and/or chromium nitride (CrN), in particular of titanium nitride (TIN), and/or titanium carbonitride (Ti(C,N)). The thin layers of these materials have intrinsic colors. Titanium nitride layers have yellow hues, mixed crystal layers with titanium carbide have bronze-colored or brownish hues, titanium carbonitride layers have a bluish gray to violet hue, and chromium nitride layers are white to brownish gray.

In a particularly preferred embodiment of the present invention, the composition of the material is chosen so that outer layers having a golden yellow to bronze-colored hue are obtained.

The superiority of the apparatus according to the invention results from the interaction of the outer layer with the structure of the surface on which it has been deposited.

Godets having the surface structure of the invention, i.e. having a roughness depth from 15 to 25 μm, are preferably used for the frictional conveyance of fiber materials or for guiding and bundling fiber materials, for example as highly looped godets in take-off and drawing units or in intermingling jets.

The interaction of such a surface of defined topography with the above-described hard outer layer results in relatively low coefficients of dry friction between the surfaces and the fiber materials.

The components of the invention can be formed for example by pressing and sintering processes known per se from cermet materials having a specific resistance of not more than 25 μΩ·cm. Such components can be for example intermingling jets. Larger components, for example godets, in contrast, are advantageously fabricated as usual from suitable steels and provided at least in the areas of their surface which come into contact with the fiber material with a "thick" layer of such a cermet material. Atop this "thick" layer of defined surface structure there is located in the particularly preferred embodiment of the invention the hard outer layer.

Figure 4:
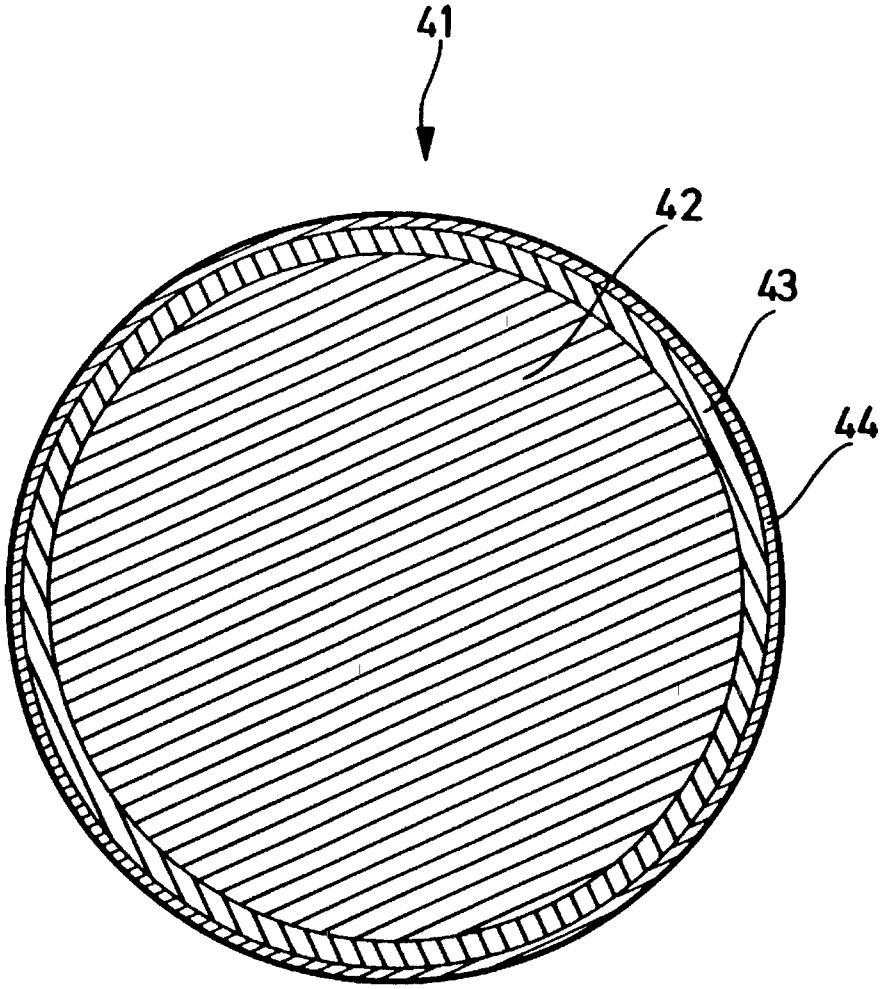
FIG. 4 is a cross section perpendicularly to the mid-line of a cylindrical godet.

FIG. 4 shows schematically a cross section perpendicularly to the mid-line of a cylindrical godet (41) according to the invention, comprising the basic body (42) made from metal, deposited on its surface a thick layer (43) having a roughness depth as defined above, and applied thereon an outer layer (44). The dimensions of godet radius and layer thicknesses are not shown to scale in the figure in order that adequate clarity may be ensured.

A preferred cermet material for the thick layer comprises tungsten carbide (WC) having a carbon content of at least 6.15% by weight with an addition from 10 to 20% by weight of a metal of group 8 of the periodic table, preferably of cobalt. An example of a particularly suitable material for such a thick layer is a cermet comprising from 85 to 88% by weight of WC and from 15 to 12% by weight of cobalt. In addition, however, the material may contain up to 5% by weight of further additions customary in hard materials.

The manufacture of the components of the invention proceeds by first making a corresponding component having a surface with the above-defined topography. Depending on the size and shape of the apparatus constructed according to the invention, this is done either by making the desired component, for example by pressing and sintering processes known per se, from the above-described cermet material, in which case the roughness depth $R_z$ of the surface is set to a value from 15 to 25 μm, or by coating the component made of customary steel by known plasma spray processes, as described for example in Ullmanns Encyklopädie der technischen Chemie, fourth Edition, Volume 16, page 546, and also Volume 2, pages 400–405, and the primary literature cited therein, with a from 100 to 400 μm thick layer of the abovementioned thick layer material. The spray parameters are set so that the process produces the above-described topography.

Atop the thick layer thus produced it is then possible, to manufacture the preferred embodiment, to apply the outer layer of the abovementioned materials by vapor deposition. The vapor deposition of thin layers is likewise a known operation and is described for example in Ullmanns Encyklopädie der technischen Chemie, fourth Edition, Volume 10, pages 257 to 260, and the primary literature cited therein.

Particular preference is given to constructing godets according to the invention.

The table below shows the differences in the service lives of a godet coated with a conventional surface comprising $Al_2O_3$ with 13% by weight of $TiO_2$ and of a godet constructed according to the invention, under identical operating conditions and at the same production rate. The end of the service life is that point at which the roughness depth falls below an $R_z$ value of 10 μm and godet wraps form despite suitable stripping devices.

TABLE

| Type of coating | Service life (days) | Comments |
|---|---|---|
| $Al_2O_3$/TiO2 on steel (conventional standard godet; comparison) | 100 | Degree of wear of surface not visually discernible |
| Thin TiN layer on WC/Co thick layer (according to the invention) | >300 | Degree of wear of surface visually discernible |

A particular advantage of the preferred godet, coated according to the invention with an outer layer, is that its surface condition is discernible from its color and planned replacement is therefore possible before the quality of the fiber material produced starts to deteriorate.

What is claimed is:

1. An implement for producing, treating, or processing fiber material comprising:

a thread-guiding component, said thread guiding component having a surface, wherein said surface contacts the fiber material, said surface is composed of a ceramic-metal composite material having an electric resistance of not more than 25 μΩ cm, said surface has a maximum roughness depth $R_{max}$, determined by averaging 5 measurements of maximum roughness depth, of between 20 and 30 μm, with the root mean square deviation of from 3 to 8 μm, said surface has an average roughness depth $R_z$, determined by averaging 5 measurements of average roughness depth, of between 15 and 25 μm, with a root mean square deviation of from 2 to 5 μm, and said surface has, for a plane at depth of cut from 6 to 12 μm, a load bearing proportion of about 10% of the surface, and, for a plane at depth of cut from 18 to 25 μm, a load-bearing proportion of about 90% of the surface.

2. A component as claimed in claim 1, wherein the slope of the depth of cut/load-bearing proportion function is from 0.11 to 0.16 μm/% within the load-bearing proportion range from 30 to 70%.

3. A component as claimed in claim 1, wherein the entire component is formed from a cermet material having a specific electrical resistance of not more than 25 μΩ·cm.

4. A component as claimed in claim 1, wherein the cermet material having an electric resistance of not more than 25 μ·cm is present in the form of a thick surface layer in the areas which come into contact with the fiber material.

5. A component as claimed in claim 1, wherein the surface cermet material has a specific electric resistance of from 20 to about 1.5 μΩ·cm.

6. A component as claimed in claim 1, wherein the component is formed in its entirety from a cermet material having a specific electric resistance of from 20 to about 1.5 μΩ·cm.

7. A component as claimed in claim 4, wherein the thick surface layer of cermet material is formed from a material having a specific electric resistance of from 20 to about 1.5 μΩ·cm.

8. A component as claimed in claim 1, wherein the material has a specific electric resistance of not more than 25 μΩ·cm and comprises tungsten carbide having a carbon content of at least 6.15% by weight with an addition of 10 to 20% by weight of a metal of group 8 of a periodic table of the elements.

9. A component as claimed in claim 8, wherein the metal of group 8 of the periodic table is cobalt.

10. A component as claimed in claim 1, wherein the component is a godet.

11. A component as claimed in claim 1, wherein the material has a specific electric resistance of not more than 25 μΩ cm and comprises tungsten carbide having a carbon content of at least 6.15% by weight with an addition of 10 to 20% by weight of a metal selected from the group consisting of Fe, Co, Ni, Ru, Rh, Pd, Os, Ir, or Pt.

12. A component as claimed in claim 11, wherein the metal is cobalt.

13. An implement for producing, treating, or processing fiber material comprising:

a thread-guiding component, said thread guiding component having a surface with an outer layer, wherein said surface contacts the fiber material, said surface is composed of a ceramic-metal composite material having an electric resistance of not more than 25 μΩ cm, said surface has a maximum roughness depth $R_{max}$, determined by averaging 5 measurements of maximum roughness depth, of between 20 and 30 μm, with the root mean square deviation of from 3 to 8 μm, and said surface has an average roughness depth $R_z$, determined by averaging 5 measurements of average roughness depth, of between 15 and 25 μm, with a root mean square deviation of from 2 to 5 μm, wherein the outer layer is titanium nitride, titanium carbon nitride, chromium nitride, or mixtures thereof.

14. A component as claimed in claim 13, wherein said cermet surface has, for a plane at depth of cut from 6 to 12 μm, a load bearing proportion of about 10% of the surface, and, for a plane at depth of cut form 18 to 25 μm, a load-bearing proportion of about 90% of the surface.

15. A component as claimed in claim 14, wherein the slope of the depth of cut/load-bearing proportion function is from 0.11 to 0.16 μm/% within the load-bearing proportion range from 30 to 70%.

16. A component as claimed in claim 13, wherein the entire component is formed from a cermet material having a specific electrical resistance of not more than 25 μΩ·cm.

17. A component as claimed in claim 13, wherein the cermet material having an electric resistance of not more than 25 μΩ·cm is present in the form of a thick surface layer in the areas which come into contact with the fiber material.

18. A component as claimed in claim 13, wherein the surface cermet material has a specific electric resistance of from 20 to about 1.5 μΩ·cm.

19. A component as claimed in claim 13, wherein the component is formed in its entirety from a cermet material having a specific electric resistance of from 20 to about 1.5 μΩ·cm.

20. A component as claimed in claim 4, wherein the thick surface layer of cermet material is formed from a material having a specific electric resistance of from 20 to about 1.5 μΩ cm.

21. A component as claimed in claim 13, wherein the material has a specific electric resistance of not more than 25 μΩ cm and comprises tungsten carbide having a carbon content of at least 6.15% by weight with an addition of 10 to 20% by weight of a metal of group 8 of a periodic table of the elements.

22. A component as claimed in claim 13, wherein the metal is cobalt.

23. A component as claimed in claim 13, wherein the component is a godet.

* * * * *